United States Patent [19]

Sano et al.

[11] Patent Number: 4,950,570

[45] Date of Patent: Aug. 21, 1990

[54] IMAGE-FORMING PROCESS USING PHOTOSENSITIVE TONER

[75] Inventors: Yumiko Sano; Kazuhito Takaoka; Yosinobu Umetani, all of Osaka, Japan

[73] Assignee: MITA Industrial Co., Ltd., Osaka, Japan

[21] Appl. No.: 276,476

[22] Filed: Nov. 28, 1988

[51] Int. Cl.[5] ..... G03G 13/44; G03G 13/24; G03G 13/22

[52] U.S. Cl. ..... 430/55; 430/102; 430/901; 430/31

[58] Field of Search ..... 430/102, 901, 31, 55

[56] References Cited

U.S. PATENT DOCUMENTS

| | | | |
|---|---|---|---|
| 2,758,939 | 8/1956 | Sugarman, Jr. | 430/901 X |
| 2,924,519 | 2/1960 | Bertelsen | 430/901 X |
| 2,940,847 | 6/1960 | Kaprelian | 430/901 X |
| 3,166,418 | 1/1965 | Gundlach | 430/102 |
| 3,986,972 | 10/1976 | Giaimo, Jr. | 430/122 X |
| 4,258,116 | 3/1981 | Takasv et al. | 430/102 |
| 4,350,440 | 9/1982 | Watanabe | 430/102 X |
| 4,368,687 | 1/1983 | Kanbe et al. | 430/102 X |
| 4,433,041 | 2/1984 | Yamashita | 430/901 X |
| 4,797,335 | 1/1989 | Hiratsuka et al. | 430/102 |

*Primary Examiner*—Paul R. Michl
*Assistant Examiner*—Jeffrey A. Lindeman
*Attorney, Agent, or Firm*—Sherman and Shalloway

[57] ABSTRACT

Disclosed in an image-forming process which comprises arranging two electrode surfaces, at least one having a curvature face and at least the other being transparent, to confront each other, forming a layer of a photosensitive toner on one of the electrode surfaces, applying a bias voltage so that the polarity of the toner layer-supporting electrode surface is the same as the polarity of charges on the toner and the polarity of the confronting electrode surface is reverse to the polarity of charges on the toner, irradiating the toner layer with light at a part where both the electrode surfaces are contacted with each other through the photosensitive toner layer, and transferring the unexposed toner toward the confronting electrode surface.

22 Claims, 8 Drawing Sheets

IMAGE-FORMING PROCESS USING PHOTOSENSITIVE TONER

BACKGROUND OF THE INVENTION (1) Field of the Invention

The present invention relates to an image-forming process. More particularly, the present invention relates to an image-forming process in which a photosensitive toner is used and a positive image is formed according to the simultaneous voltage application/light exposure/transfer system.

(2) Description of the Prior Art

A process in which a photosensitive toner is used and an image is formed according to the simultaneous voltage application/light exposure/transfer system has already been known. For example, Japanese Patent Application Laid-Open Specification Nos. 98463/85 and 138566/85 disclose a process in which a photosensitive toner layer is formed on an electroconductive substrate, a transparent electrode is arranged to confront the toner layer, a bias voltage is applied so that the polarity of the toner-adhering substrate is reverse to the polarity of the toner and the polarity of the confronting electrode is the same as that of the toner, imagewise light exposure is carried out and an irradiated toner image is transferred to the confronting electrode to form an image.

However, according to this simultaneous voltage application/light exposure/transfer process, charges having a polarity reverse to the inherent polarity of the toner are injected into the photosensitive toner in the light-exposed region (bright region), and this toner charged with the reverse polarity is electrostatically attracted to the confronting electrode to form an image. Accordingly, the image formed by this process is a negative image, and theoretically, it is impossible to form a positive image on the side of the confronting electrode according to this process.

Furthermore, according to this process, various steps such as formation of the toner layer, erasion of charges from the toner, injection of charges into the toner and movement of toner particles from the electrode surface, for example, isolation (repulsion), are conducted in one zone, and therefore, the process is defective in that formation of a clear and sharp image with no fogging or no disturbance is difficult.

Moreover, in an ordinary electroscopic toner used for development in a photosensitive drum, in view of the charge quantity of the toner, the scattering property of the toner and the resolving power, the particle size has heretofore been adjusted within a certain range, for example, a range of from 5 to 20 μm. Also in the field of the photosensitive toner, a particle size within this range has been similarly used.

However, in the image-forming process using a photosensitive toner, since the charged toner is light-exposed, there arises a problem quite different from the problem involved in an ordinary electroscopic toner. More specifically, since the photosensitive layer is composed of independent toner particles, obscuration of letters or fogging is often caused at the development and light exposure.

Various photoconductors and fixing resins have been proposed, but influences of the particle size characteristics on the photosensitivity, image density and image quality are almost unknown.

SUMMARY OF THE INVENTION

It is a primary object of the present invention to provide an image-forming process in which a photosensitive toner is used and a positive image is formed according to the simultaneous voltage application/light exposure/transfer system.

Another object of the present invention is to provide a process in which a clear and sharp image having a high density can be formed by a very simple system.

Still another object of the present invention is to provide a process for forming an image by using a photosensitive toner and a magnetic carrier in combination according to the simultaneous voltage application/light exposure/transfer system, in which the apparent photosensitivity of the photosensitive toner is improved and a clear and sharp image having a high density can be formed without fogging or obscuration of letters.

A further object of the present invention is to provide an improved process in which a clear and sharp image with no fogging can be stably formed, irrespectively of the deviation of the transparent electrode surface or the deviation of the developing sleeve.

More specifically, in accordance with the present invention, there is provided an image-forming process which comprises arranging two electrode surfaces, at least one having a curvature face and at least the other being transparent, to confront each other, forming a layer of a photosensitive toner on one of the electrode surfaces, applying a bias voltage so that the polarity of the toner layer-supporting electrode surface is the same as the polarity of charges on the toner and the polarity of the confronting electrode surface is reverse to the polarity of charges on the toner, irradiating the toner layer with light at a part where both the electrode surfaces are contacted with each other through the photoconsitive toner layer and transferring the unexposed toner toward the confronting electrode surface.

In the present invention, it is preferred that an electroconductive sleeve be used as the toner layer-supporting electrode surface, the electroconductive sleeve be provided with a magnet arranged therein, and the photosensitive toner be supported in the form of a magnetic brush composed of a mixture of the photosensitive toner with a magnetic carrier on the electroconductive sleeve.

In accordance with one preferred embodiment of the present invention, there is provided an image-forming process comprising forming a magnetic brush composed of a mixture of a photosensitive toner and a magnetic carrier on an electroconductive sleeve, bringing the magnetic brush into contact with a transparent electrode surface, applying a bias voltage between the electroconductive sleeve and the transparent electrode surface and subjecting a part of said contact to the imagewise light exposure through the transparent electrode surface to form a photosensitive toner image on the electrode surface, wherein the bias voltage is applied so that the polarity of the electroconductive sleeve is the same as the polarity of charges on the toner and the polarity of the transparent electrode surface is reverse to the polarity of charges on the toner, and the developing conditions are set so that 1 to 2 photosensitive toner layers are formed on the transparent electrode surface in the non-light-exposed state.

It is preferred that a photosensitive toner having such particle size characteristics that the median diameter based on the volume is 5 to 10 μm, especially 6 to 8 μm, and the standard deviation value of the particle size distribution based on the volume is smaller than 3.33 μm be used as the photosensitive toner.

Furthermore, it is preferred that the concentration (Ct, %) of the photosensitive toner in the mixture for forming the magnetic brush should satisfy the following requirement:

$$Ct = k \cdot \frac{Sc}{St + Sc} \times 100 \quad (1)$$

wherein Sc stands for the specific surface area ($cm^2/g$) of the magnetic carrier, St stands for a specific surface area ($cm^2/g$) of the photosensitive toner, and k is a number of from 1.0 to 2.0.

Moreover, it is preferred that the imagewise light exposure width be smaller than the width of the contact between the magnetic brush and the transparent electrode surface and the light exposure width be set so that the top end of the imagewise light exposure width slightly protrudes over the top of said contact width in the direction of advance of the transparent electrode surface.

DETAILED DESCRIPTION OF THE PREFERRED EMBODIMENTS

Figure 1:
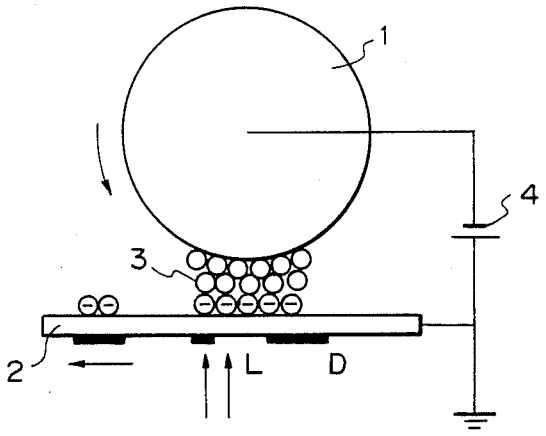
FIG. 1 is a schematic side view illustrating the principle of the present invention.

Refering to FIG. 1 illustrating the principle of the present invention, a toner-supporting electrode 1 and a confronting electrode 2 are arranged to confront each other. At least one of the electrodes 1 and 2 should have a curvature face, and at least the other electrode should be transparent. In an example illustrated in FIG. 1, the toner-supporting electrode 1 has a curvature face and the confronting electrode is transparent and flat.

A photosensitive toner layer 3 is formed on the surface of the toner-supporting electrode 1, and the toner-supporting electrode 1 is contacted with the confronting electrode 2 through this photosensitive toner layer 3.

The toner-supporting electrode 1 and the confronting electrode 2 are connected to a bias voltage source 4, and a bias voltage is applied so that the polarity of the toner-supporting electrode 1 is the same as the polarity of charges on the toner, that is, a negative polarity, and the polarity of the confronting electrode 2 is reverse to the polarity of charges on the toner, that is, a positive polarity. Simultaneously, the photosensitive layer 3 is subjected to the imagewise light exposure at the above-mentioned contact part through the transparent confronting electrode 2, whereby the photosensitive toner is rendered electrically conductive in a bright region L, and the charges are caused to disappear on injection of charges through confronting electrode 2 or the photosensitive toner comes to have positive charges. Accordingly, the toner in the bright region L is not attracted to the confronting electrode 2 but is left on the toner-supporting electrode 1. On the other hand, in a dark region D, since the polarity of the photosensitive toner is kept negative, the photosensitive toner moves toward the confronting electrode having the positive polarity 2 along the bias electric field applied between the two electrodes to effect transfer of a positive image.

Alternatively, the toner is first transferred to the confronting electrode 2 from the toner-supporting electrode 1 and the photosensitive toner is subjected to the light exposure in this state, whereby the toner loses the charges in the bright region L or the toner comes to have a positive polarity and the toner is pushed back to the supporting electrode 1. On the other hand, in the dark region D, the toner is left on the side of the confronting electrode 2. Thus, transfer of a positive image is effected.

Transfer of the toner can be performed according to either the former process or the latter process, or both the processes can be simultaneously adopted.

Figure 2:
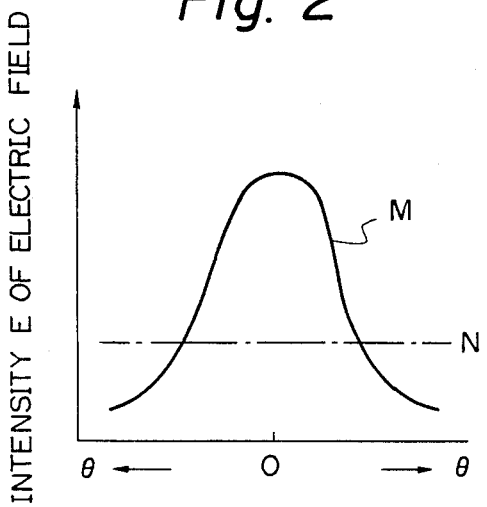
FIG. 2 is a graph illustrating the relation between the angle from the standard position and the intensity of the electric field between the two electrodes.

In the present invention, in order to perform formation of a positive image at the simultaneous voltage application/light exposure/transfer, it is important that at least one of the electrode surfaces should have a curvature face. If the relation between the angle $\theta$ from the standard position where the electrode surface of the toner-supporting electrode 1 comes closest to the confronting electrode surface and the intensity E of the electric field between the two electrodes is plotted, a graph as shown in FIG. 2 is obtained. In FIG. 2, the line N shows that the Coulomb repulsive force is balanced with the adhering force of the toner-supporting electrode surface, and transfer of the toner is effected in the region where the electric field intensity curve M is located above the line N.

Figure 3:
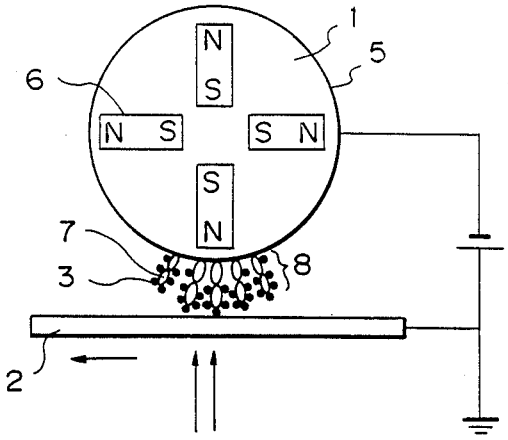
FIG. 3 is a schematic side view illustrating an example of the process of the present invention.

In a preferred embodiment of the present invention, as shown in FIG. 3 an electroconductive sleeve 5 is used as the toner layer-supporting electrode 1, a magnet 6 is disposed in the electroconductive sleeve 5, the photosensitive toner is used in the form of a mixture with a magnetic carrier 7, a magnetic brush 8 is formed on the sleeve 5, and the simultaneous voltage application/light exposure/transfer is carried out while bringing the magnetic brush into sliding contact with the confronting electrode 2. In this preferred embodiment, the photosensitive toner 3 is held on the surface of the magnetic carrier and the contact between the photosensitive toner 3 and the confronting electrode 2 is accomplished smoothly, and simultaneously, injection of charges into the photosensitive toner 3 is effected. The toner which has adhered to the confronting electrode surface 2 and has lost the charges is caught by the magnetic carrier 7 and a transferred image having a high contrast can be formed.

In the present invention, it is preferred that the transfer of the toner toward the confronting electrode be accomplished by transferring the toner to the confronting electrode per se or to a transfer material formed on the confronting electrode on the side confronting the toner-supporting electrode. In the case where the light exposure is effected from the confronting electrode side, this transfer material should, of course, be transparent.

At least one of the toner-supporting electrode and confronting electrode has a curvature face, and it is preferred that the radius (r) of curvature by 10 to 100 mm, especially 20 to 50 mm. As pointed out hereinbefore, it is preferred that the toner-supporting electrode be an electroconductive sleeve (cylindrical member) having the radius of curvature within the above-mentioned range and the confronting electrode be a flat or cylindrical transparent electrode.

Figure 4:
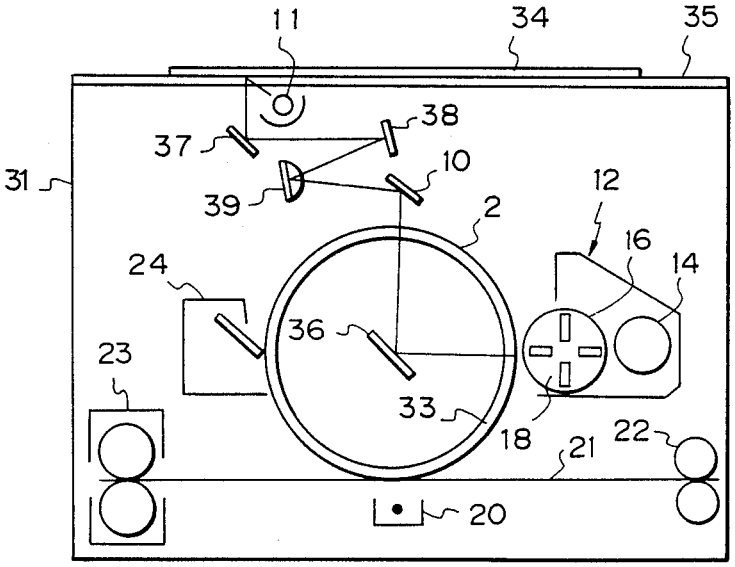
FIG. 4 is a diagram illustrating an example of an apparatus for use in carrying out the process of the present invention.

Referring to FIG. 4 illustrating an example of an apparatus which is preferably used for carrying out the process of the present invention, a transparent drum 33 having a transparent electrode surface 2 on the outer surface thereof is arranged within a machine frame 31. A transparent plate 35 supporting an original 34 is arranged in the upper portion of the machine frame 31. A light exposure mirror 36 is fixed substantially at the center of the transparent drum 33, and the light exposure mirror 36 is optically connected to the transparent plate 35 through, for example, a first movable mirror 37, a second movable mirror 38, an in-mirror lens 39 and a stationary mirror 10. A light exposure lamp 11 is arranged to illuminate the original on the transparent plate 35.

A developing device represented as a whole by reference numeral 12 is arranged in an optical path extended along the circumference of the transparent drum 33 from the light exposure mirror 36. This developing device 12 comprises a stirring roller 14 for mixing a photosensitive toner 13 and a magnetic carrier 17 (see FIG. 5) and a developing sleeve 16 for forming a magnetic brush 15 of this mixture on the surface thereof. The surface of the developing sleeve 16 is electrically conductive, and a magnet 18 for forming the magnetic brush is rotatably or stationarily arranged within the developing sleeve 16. In this embodiment, in order to apply a bias voltage between the transparent electrode face 2 and the developing sleeve 16, the transparent electrode surface 2 is earthed, while the developing sleeve 16 is connected to a bias voltage source 19.

A toner image transfer mechanism 20 is arranged along the rotation direction of the transparent drum 33 subsequently to the developing device 12. More specifically, a copy sheet supply mechanism 22 for supplying a copy sheet 21 is arranged so that the copy sheet 21 falls in contact with the surface of the transparent drum 33 at the position of the transfer mechanism 20. In this embodiment, the transfer mechanism 20 is a corona charger, and charges having a polarity reverse to the polarity of charges of the toner are emitted from the back face of the copy sheet 21 in the state where the copy sheet 21 is piled on the drum 33 having a toner image 25, whereby the toner image 25 (see FIG. 5) is transferred to the copy sheet 21 from the drum 33. A fixing mechanism 23, for example, a heating roller, is arranged in the delivery direction of the copy sheet 21 to thermally fix the toner image transferred onto the copy sheet 21.

A cleaning mechanism 24 is arranged along the rotation of the transparent drum subsequently to the transfer mechanism 20, and after the transfer of the toner, the excessive toner left on the surface of the drum surface is removed by cleaning.

Figure 5:
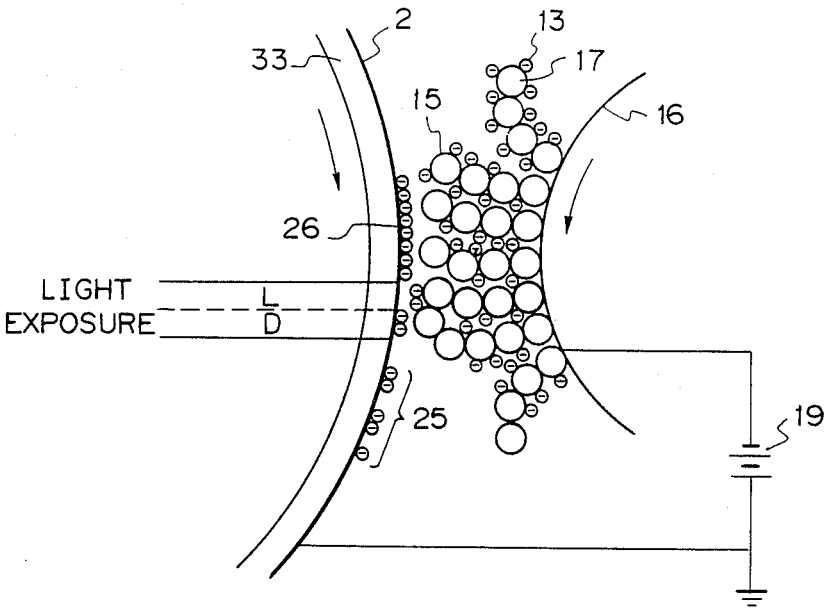
FIG. 5 is an enlarged diagram illustrating a simultaneous light exposure/transfer portion of a photosensitive toner in FIG. 4.

Referring to FIG. 5, which is an enlarged diagram illustrating the zone of the simultaneous light exposure/transfer of the photosensitive toner, the developing sleeve 16 is in proximity to the transparent electrode surface 2 of the drum 33, and the magnetic brush 15 composed of the mixture of the magnetic carrier 17 and the photosensitive toner 13 is formed on the sleeve 16, and the magnetic brush 15 is brought into sliding contact with the transparent electrode surface 2. The photosensitive toner 13 is charged with charges of a certain polarity (for example, a negative polarity) by mixing with the magnetic carrier 17 and is attracted to the magnetic carrier 17 charged with charges of the reverse polarity by the Coulomb force. A bias voltage is applied to the transparent electrode surface 2 from the power source 19 so that the polarity of the transparent electrode surface 2 is reverse (for example, positive) to the polarity of the photosensitive toner 13, whereby a thin layer 26 of the photosensitive toner 13 is formed on the transparent electrode surface 2. The toner layer 26 is subjected to the slit light exposure through the transparent drum 33 and the transparent electrode surface 2. In the dark region D, the photosensitive toner 13 is held on the electrode surface 2 by the Coulomb force, but in the bright region L, injection of charges of the reverse polarity (for example, positive polarity) is effected by the photoconductivity of the toner 13, and therefore, the toner 13 is moved toward the magnetic brush 15, whereby a toner image 25 corresponding to the dark region D is formed.

The present invention also is based on the finding that if the developing conditions are set so that 1 to 2 layers of the photosensitive toner 13 are formed as the toner layer 26 applied to the transparent electrode surface 2, the apparent photosensitivity of the photosensitive toner is improved and a clear and sharp image having a high density can be obtained without fogging or disturbance such as obscuration of letters.

In the instant specification, by "one layer" of the photosensitive toner, it is meant that under microscope observation, the toner adheres to the transparent electrode surface in one layer in the state where the toner is packed most densely or substantially most densely. If the particle size characteristics of the photosensitive toner are determined, adhesion of the toner as one layer has one-to-one correspondence to the amount ($g/m^2$) of the adherent toner per unit area. Accordingly, an adhering amount larger than this adhering amount (the adherent amount as one layer) or the adhering amount smaller than this adhering amount can be called an adherent amount larger or smaller than one layer.

Figure 6:
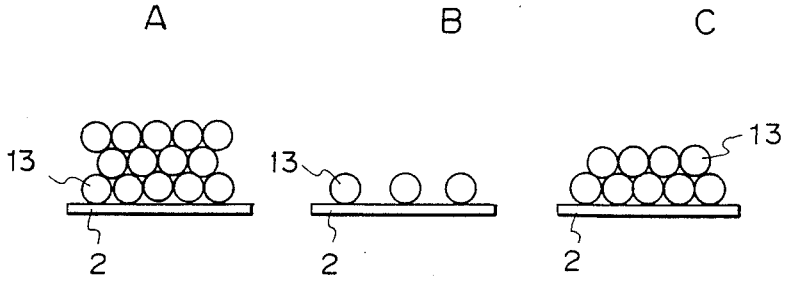
FIG. 6 is a diagram illustrating adhesion states of various toners onto a transparent electrode surface.

Referring to FIG. 6 illustrating various states of the adhering toner, A shows the state where the toner particles adhere in a thickness larger than two layers. In this case, charges are attenuated in the particles present in the front layer by irradiation with light, but attenuation of charges are not caused in the particles present in the lower layers by irradiation with light and light attenuation of charges in the particles of the front layer is disturbed by the particles of the lower layers. Accordingly, the photosensitivity of the photosensitive toner as a whole is reduced, with the result that fogging is increased and disturbance of the image is often caused. B shows the state where the toner particles 13 adhere in a thickness smaller than one layer. In this case, no problem arises in connection with the photosensitivity, but the image density is reduced and the contrast of the image is reduced. C shows the state where the toner particles 13 are applied in a thickness of one to two layers, and in this case, the light attenuation of charges is sufficiently effected throughout the toner layer and a sufficient image density can be obtained.

Figure 7:
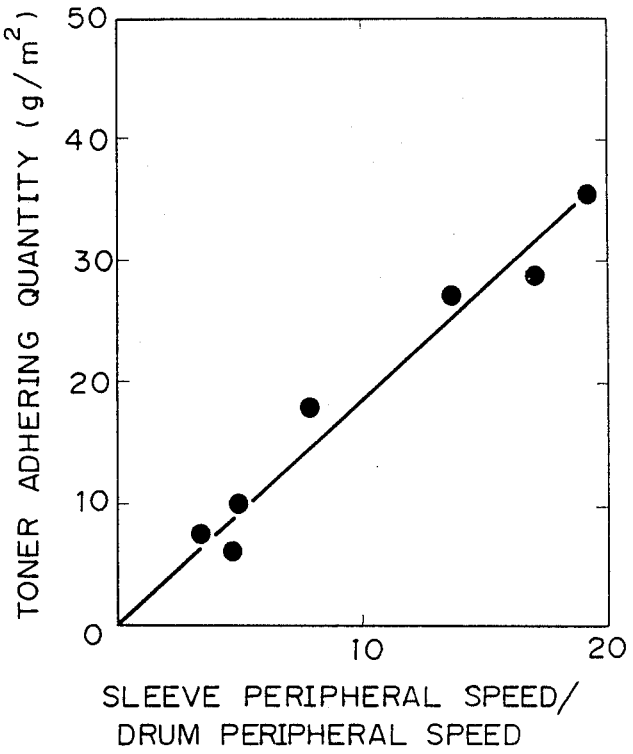
FIG. 7 is a graph illustrating the relation between the ratio of the peripheral speed of an electroconductive sleeve to the peripheral speed of a drum and the quantity of an adhering toner.

The thickness of the toner applied to the transparent electrode surface 2 depends on the particle size characteristics of the photoconductive toner 13 and the applied bias voltage, but it depends mostly on the rate of feed of the toner to the electrode surface 2, that is, the ratio (R) of the peripheral speed of the electroconductive sleeve to the peripheral speed of the drum. FIG. 7 illustrates the relation between the ratio of the peripheral speed of the electroconductive sleeve to the peripheral speed of the drum, plotted on the abscissa, and the adhering amount ($g/m^2$) of the toner, plotted on the ordinate. The relation shown in FIG. 7 is one determined with respect to a toner having a median diameter of 7 $\mu$m and a particle size distribution standard deviation value ($\sigma$) of 2.24 $\mu$m. In FIG. 7, the adhering amount of 11 $g/m^2$ corresponds to the thickness of one layer and the adhering amount of 22 $g/m^2$ corresponds to the thickness of two layers. From FIG. 7, it will be understood that if the above-mentioned peripheral speed ratio (R) is arranged within the range of from 6 to 12, the photosensitive layer is applied in a thickness of 1 to 2 layers. From the viewpoint of the image quality, it is especially preferred that the peripheral speed ratio (R) be adjusted within the range of from 7 to 8.

The present invention also is based on the finding that a maximum value of the photosensitivity is present if the particle size of the photosensitive toner is within a certain range, and if the main diameter based on the volume (hereinafter referred to merely as "median diameter") is in the range of 5 to 10 $\mu$m, especially 6 to 8 $\mu$m, and the standard deviation value ($\sigma$) of the particle size distribution based on the volume is smaller than 3.33 $\mu$m, especially smaller than 2.24 $\mu$m, the photosensitivity is conspicuously improved.

Figure 8:
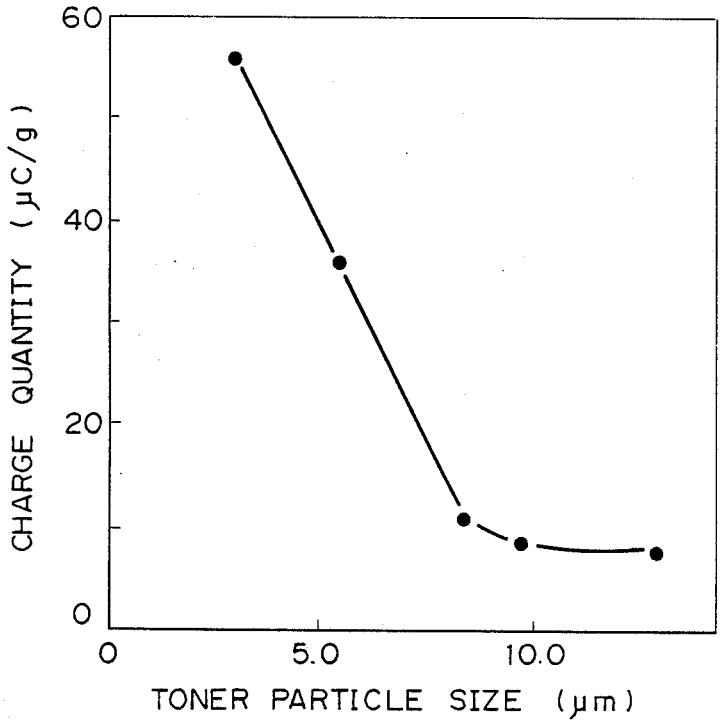
FIG. 8 is a graph illustrating the relation between the median particle diameter of a photosensitive toner and the charge quantity of the toner.
Figure 9:
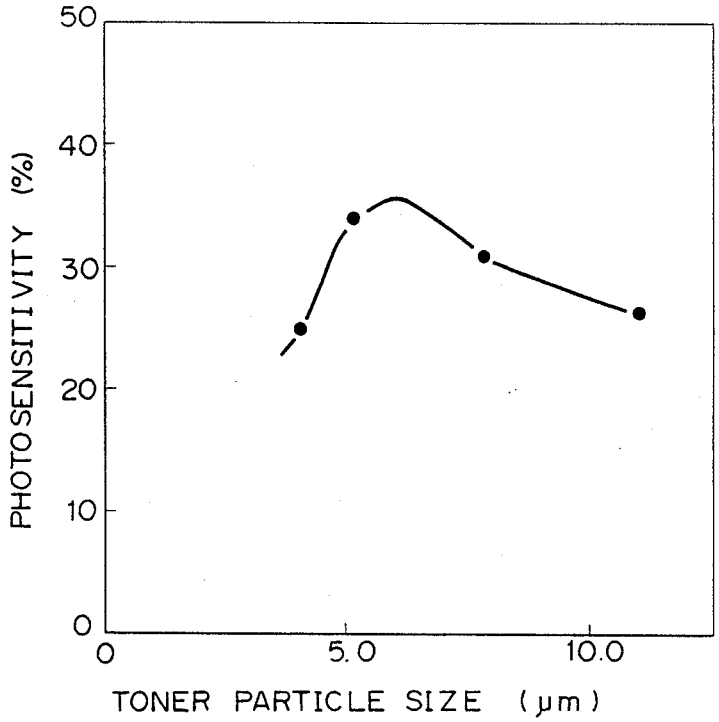
FIG. 9 is a graph illustrating the relation between the median particle size of a photosensitive toner and the photosensitivity of a layer of the photosensitive toner layer formed on an electroconductive substrate.

In FIG. 8 of the accompanying drawings, with respect to photosensitive toners shown in the examples given hereinafter, the relation between the median particle diameter ($\mu$m) and the charge quantity ($\mu c/g$) of the toner is plotted. With respect to the same photosensitive toners, the relation between the median particle diameter ($\mu$m) and the photosensitivity of the photosensitive toner layer formed on an electroconductive substrate is plotted in FIG. 9.

From these graphs, it will be understood that as in case of an ordinary electroscopic toner, the charge quantity of the toner per unit weight is reduced as the particle size increases. It also will be understood that the photosensitivity of a layer of a photosensitive toner has a maximum value if the particle size is within a certain range and the photosensitivity is reduced if the particle size is smaller or larger than the particle sizes within this certain range. The reasons are considered to be as follows. If the toner particle size exceeds the above-mentioned range, the charge quantity per unit weight is small and the light attenuation speed per particle is low, and therefore, the photosensitivity is reduced. If the particle size is below the above-mentioned range, the light attenuation speed per particle is high, but if the photosensitive toner is formed into a toner layer, the toner particles are laminated in a plurality of layers, and attenuation of charges is caused in the particles of the front layer but light attenuation of the particles in the lower layers is not caused and light attenuation of charges of the particles in the front layer is disturbed by the particles of the lower layers, with the result that the photosensitivity of the toner layer as a whole is reduced.

If the photosensitivity of the photosensitive toner is low for the foregoing reasons, attenuation of charges on the toner particles is slow and injection of charges of a different polarity is insufficient, and therefore, migration of the photosensitive toner particles is insufficient and fogging is caused.

If the particle size exceeds the above-mentioned range, since the charge quantity of the toner per unit weight is small, the image area is disturbed by an outer disturbance such as sliding contact with the magnetic brush, and obscuration of letters is caused.

In the present invention, it is important that the requirement that the particle size distribution is so narrow that the standard deviation value ($\sigma$) is smaller than 3.33 $\mu$m, especially smaller than 2.24 $\mu$m, should be satisfied in addition to the requirement that the median diameter is 5 to 10 $\mu$m, especially 6 to 8 $\mu$m. If the value $\sigma$ becomes large, the above-mentioned defects are caused to appear because of a small diameter distribution portion or a large diameter distribution portion, and fogging or obscuration of letters is caused.

The process of the present invention is especially advantageously applied to the system for forming an image by applying a bias voltage so that the transparent electrode surface has a polarity reverse to the polarity of charges on the toner and the confronting electrode surface has the same polarity as that of charges on the toner. According to this system, the photosensitive toner migrates toward the transparent electrode surface from the confronting electrode surface in the developing zone, and the light exposure is effected in the state where the photosensitive toner adheres to the transparent electrode surface, and in the bright region (L), charges of the toner particles disappear or are repulsed by injection of charges of a reverse polarity, and an image is formed on the transparent electrode surface. If the photosensitive toner specified in the present invention is used, the process is conducted rapidly with certainty, and a positive image having a high contrast and a high density can be formed without fogging or obscuration of letters.

The present invention also is based on the finding that in the case where a photosensitive toner is used in combination with a magnetic carrier, in order to reduce the fog density and improve the image density, an optimum value of the toner concentration is present at a level much lower than in case of an ordinary two-component type developer.

The right side Sc/(St+Sc) of the formula (1) relates to the specific surface areas of the carrier and toner. Namely, the right side of the formula (1) indicates the ratio of the surface area occupied by the carrier to the total surface area of a composition formed by mixing equal weights of the carrier and toner (hereinafter referred to as "the surface area occupancy ratio of the carrier"). In case of an ordinary two-component type developer, the toner concentration (Ct, %) is the same as or close to the surface area occupancy ratio of the carrier. More specifically, the toner concentration is such that the value of k is from 0.80 to 1.14. In contrast, in the process of the present invention, a toner image is formed at such a low concentration (Ct, %) of the photosensitive toner in the two-component type developer that the value of k in the formula (1) is 1.0 to 2.0, especially 1.2 to 1.8.

Figure 10:
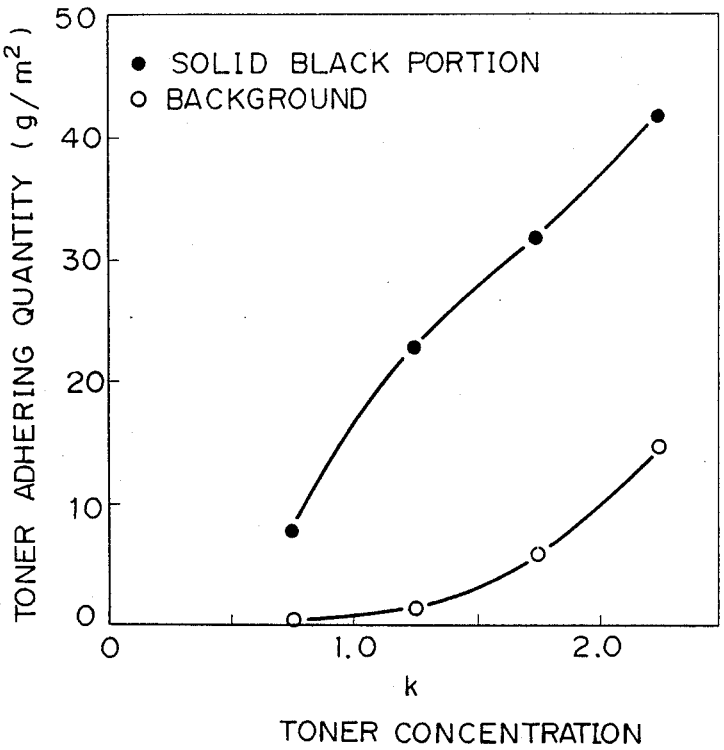
FIG. 10 is a graph illustrating the relation between the adhering quantity and the density, in which the concentration of a photosensitive toner and the k value calculated from the formula (1) are plotted on the abscissa and the quantities of the toner adhering to the solid black portion and the background are plotted on the ordinate.

FIG. 10 of the accompanying drawings illustrates the relation between the adhering quantity and the toner concentration, in which the concentration (Ct, %) of the photosensitive toner in the two-component type developer and the value k calculated according to the formula (1) are plotted on the abscissa and the adhering amounts ($g/m^2$) of the toner in the solid black portion and background are plotted on the ordinate. From the results shown in FIG. 10, it will be understood that if the value of k of the toner concentration is below the range specified in the present invention, the density of the image area is extremely low and even if the toner concentration exceeds the range specified in the present invention, the density of the image area is hardly improved but the fog density of the background is rather increased.

The reason has not been completely elucidated, but it is considered that the reason will be as described below. More specifically, the charge quantity of the toner depends on the toner concentration, and in general the higher is the toner concentration, the smaller is the charge quantity. On the other hand, the amount of the toner adhering to the electrode surface is in inverse proportion to the charge quantity of the toner. Accordingly, if the toner concentration is below the range specified in the present invention, the amount of the toner adhering to the electrode surface is decreased, resulting in reduction of the image density. If the toner concentration exceeds the range specified in the present invention, the amount of the toner adhering to the electrode surface is sufficient, but the thickness of the layer of the adhering toner is increased and therefore, attenuation of charges is not sufficient in the lower layers at irradiation with light and fogging is caused, though attenuation of charges is caused in the front layer.

Figure 11:
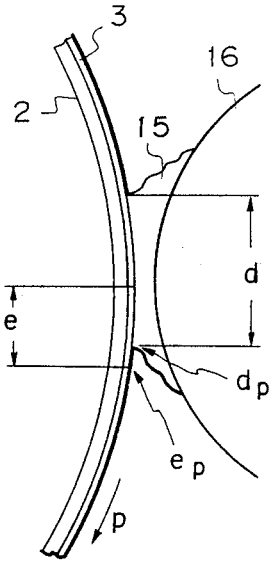
FIG. 11 is a diagram illustrating the positional relationship between the width of the contact between a magnetic brush and a transparent electrode surface and the width of the imagewise light exposure.

Referring to FIG. 11 illustrating the positional relationship between the width of contact between the magnetic brush 15 and the transparent electrode surface 2 and the imagewise light exposure width, the transparent electrode surface 2 has a contact width along which the magnetic brush 15 is contacted with the transparent electrode surface 2, that is, a developing width d, and a light exposure width e along which rays are incident on the transparent electrode surface 2. In accordance with another preferred embodiment of the present invention, the imagewise light exposure width e is made smaller than the developing width d, and the top end $e_p$ of the imagewise light exposure width e is slightly protruded over the top end $d_p$ of the contact width (developing width) d in the direction p of advance of the transparent electrode surface.

As pointed out hereinbefore, according to the image-forming process of the present invention, the toner in the bright region L is rendered photoconductive and charges are caused to disappear or charges of a reverse polarity are injected, and movement of the toner toward the magnetic brush (repulsion from the electrode surface) is caused and an image is formed. Since sliding contact is always maintained between the transparent electrode surface and the magnetic brush and a bias voltage is applied so that the polarity of the transparent electrode surface is reverse to the polarity of the toner, if the once light-exposed electrode surface is isolated from light and brought in contact with the magnetic brush, the unexposed toner adheres to the electrode surface again and fogging is caused. In contrast, according to the present invention, since the top end $e_p$ of the imagewise light exposure width e is slightly protruded over the top end $d_p$ of the developing width d in the direction of advance of the drum, the light exposure is continued until the contact with the magnetic brush is released, and re-adhesion of the unexposed toner to the once light-exposed electrode surface is prevented, with the result that occurrence of fogging is completely prevented.

In the practical image-forming operation, deviation or deflection is caused in the rotation of the developing sleeve or transparent drum, and deviation of the position of the top end $d_p$ of the developing width d cannot be avoided. According to the present invention, since the top end $e_p$ of the imagewise light exposure width e is slightly protruded over the top end $d_p$ of the developing width d, even if such deviation of the position is caused, the light exposure is continued assuredly until the contact with the magnetic brush is released, and occurrence of fogging can be prevented assuredly.

In the present invention, particles of a composition formed by dispersing a photoconductive pigment, for example, an inorganic photoconductor such as zinc oxide or CdS, or a photoconductive organic pigment such as a perylene pigment, a quinacridone pigment, a pyranthrone pigment, a phthalocyanine pigment, a disazo pigment or a trisazo pigment, in an electrically insulating fixing medium are used as the photoconductive toner. It is preferred that the photoconductive pigment be used in an amount of 3 to 600 parts by weight, especially 5 to 500 parts by weight, per 100 parts by weight of the fixing medium. If the amount of the photoconductive pigment is below the above-mentioned range, the image density or the sensitivity of the toner tends to decrease, and if the amount of the photoconductive pigment exceeds the above-mentioned range, the charge-retaining property is degraded.

A known electrically insulating fixing resin can be used as the fixing medium. For example, there can be used polystyrene, a styrene/acrylic copolymer, an acrylic resin, a polycarbonate, a polyarylate (polyester of bisphenol A with isophthalic acid or terephthalic acid), polyvinyl butyral and polysulfone. Furthermore, a photoconductive resin such as polyvinyl carbazole can be used singly or in combination with an electrically insulating resin for attaining the objects of the present invention.

In the case where the photoconductive pigment has no sensitivity to wavelengths of the visible region, a known dye sensitizer or chemical sensitizer can be incorporated.

A charge-transporting medium is used as the fixing medium, a photoconductive pigment as mentioned above is dispersed as the charge-generating pigment in this charge-transporting medium, and the formed dispersion is used as the photoconductive toner. As the charge-transporting medium, an electrically insulating resin as mentioned above is used in combination with at least one charge-transporting substance selected from hole-transporting substances such as polyvinyl carbazole, phenanthrene, N-ethylcarbazole, 2,5-diphenyl-1,3,4-oxadiazole,2,5-bis(4-diethylaminophenyl)-1,3,4-oxadiazole, bis-diethylaminophenyl-1,3,6-oxadiazole, 4,4'-bis(diethylamino-2,2'-dimethyltriphenylmethane), 2,4,5-triaminophenylimidazole, 2,5-bis(4-diethylaminophenyl)-1,3,4-triazole, 1-phenyl-3-(4-diethylaminostyryl)-5-(4-diethylaminophenyl)-2-pyrazoline and p-diethylaminobenzaldehydo-(diphenylhydrazone), and electron-transporting substances such as 2-nitro-9-fluorenone, 2,7-dinitro-9-fluorenone, 2,4,7-trinitro-9-fluorenone, 2,4,5,7-tetranitro-9-fluorenone, 2-nitrobenzothiophene, 2,4,8-trinitrothioxanthone, dinitroanthracene, dinitroacridine and dinitroanthraquinone. The charge-transporting substance is generally used in an amount of 10 to 200 parts by weight, especially 30 to 120 parts by weight, per 100 parts by weight, especially 30 to 120 parts by weight, per 100 parts by weight of the resin.

In addition the above-mentioned indispensable components, known assistants can be incorporated into the photoconductive toner of the present invention according to known recipes. As the assistant, there can be mentioned offset-preventing agents such as waxes and pressure fixability-imparting agents.

Formation of the toner can be performed according to the dry method comprising kneading, pulverization and sieving or the wet method in which a liquid dispersion is sprayed and granulated. Toner particles having the above-mentioned median diameter and particle size distribution are formed by subjecting the so-formed toner to a strict classifying operation such as air classification. A flowability improver such as finely divided hydrophobic silica or finely divided carbon black can be incorporated into the so-formed toner particles by sprinkling.

As preferred examples of the photoconductive toner, there can be mentioned a zinc oxide-styrene/acrylic copolymer resin type, a phthalocyanine-styrene/acrylic copolymer resin type and a phthalocyanine-polyester resin type. These photoconductive toners have a frictional charging characteristic of a negative polarity. A photoconductive toner having a frictional charge characteristic of a positive polarity can be prepared by using a resin containing nitrogen atoms of polyamide type resins in the main chain or side chain instead of the above-mentioned resin.

The specific surface area (St) of the photoconductive toner is generally 5000 to 2000 $cm^2/g$ and especially 7500 to 10000 $cm^2/g$, though the specific surface area is changed to some extent according to the particle size and the particle shape.

Magnetic carriers customarily used in the field of the electrophotographic reproduction can be optionally used as the magnetic carrier in the present invention. For example, an iron powder carrier and a ferrite carrier can be used. A carrier having an indeterminate shape or a spherical shape can be used. The particle size (number average particle size) of the carrier is generally 40 to 110 microns and especially 40 to 60 microns, and since the particle size is within the above-mentioned range, the specific surface area is generally 50 to 500 $cm^2/g$ and especially 300 to 400 $cm^2/g$.

An iron powder having an edge-removed indeterminate shape (hereinafter referred to as "indeterminate spherical shape") is one preferred example of the magnetic carrier, and an indeterminate spherical magnetic carrier having a loose apparent specific gravity of 2.65 to 3.20 g/cc and such a particle size distribution that particles having a size smaller than 105 microns occupy at least 90% by weight of the entire carrier and particles having a particle size of 37 to 74 microns occupy at least 50% by weight of the entire carrier is especially preferred.

As another preferred example of the magnetic carrier, there can be mentioned a so-called ferrite carrier, and sintered ferrite particles, especially spherical sintered ferrite particles, are advantageously used. It is generally preferred that the particle size of the sintered ferrite particles be 20 to 100 microns.

If the particle size of the sintered ferrite particles is smaller than 20 microns, good earing of the magnetic brush is hardly attained. If the particle size of the sintered ferrite particles exceeds 100 microns, a brush mark, that is, a scratch mark, is formed in the formed toner image.

The sintered ferrite particles used in the present invention are known. For example, there can be used sintered ferrite particles composed of at least one member selected from zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodium iron oxide ($NdFeO_3$), barium iron oxide ($BaFe_{12}O_{19}$), magnesium iron oxide ($MgFe_2O_4$), manganese iron oxide ($MnFe_2O_4$) and lanthanum iron oxide ($LaFeO_3$). Sintered ferrite particles composed of manganese zinc iron oxide are especially preferred for attaining the objects of the present invention.

The surfaces of the magnetic carrier particles can by thinly coated with an organic resin such as an acrylic resin or a silicone resin.

The photoconductive toner is mixed with the magnetic carrier at a weight ratio represented by the formula (1), generally at a weight ratio of from 96/4 to 92/8, preferably at a weight ratio of from 95/5 to 93/7, and the mixture is used for formation of a magnetic brush. Various sleeves can be used for formation of a magnetic brush. For example, there can be mentioned a fixed magnet/rotated sleeve type, a fixed sleeve/rotated magnet type, and a sleeve rotated/magnet rotated type.

A transparent drum formed of a material having an excellent transparency and no optical strain can be used in the present invention. For example, drums formed of resins such as an acrylic resin, a diethylene glycol bisallyl carbonate resin, an ordinary carbonate resin and a poly-4-methylpentene-1 resin, and ceramic drums formed of glass and glass ceramics, can be used. An electro-conductive glass (NESA glass), a tin oxide electroconductive layer and an indium-tin oxide electroconductive layer (ITO) can be used as the transparent electrode surface.

In general, the earing length of the magnetic brush is in the range of 0.3 to 1 mm, though the earing length is changed to some extent according to other conditions.

The bias voltage to be applied between the developing sleeve and the transparent electrode of the drum has the above-mentioned polarity, and the bias voltage is generally 200 to 800 volts and especially 300 to 600 volts. The average intensity of the electric field between the developing sleeve and the transparent electrode is 2 to 16 kV/cm, especially 4 to 6 kV/cm. If these conditions are satisfied, a good balance is attained between the image density and the prevention of fogging.

The imagewise light exposure is effected by the transparent light exposure through a transparent original or by the reflection light exposure from an opaque original. In each case, the slit light exposure is carried out.

In the present invention, the ratio (e/d) of the imagewise light exposure width e to the developing width d is preferably in the range of from 0.2 to 0.8, especially from 0.4 to 0.6. If the ratio e/d is below the above-mentioned range, the light exposure efficiency is low and fogging is often caused. If the ratio e/d exceeds the above-mentioned range, the sharpness of the formed image is often degraded by the deviation of the optical image or the like. It is generally preferred that the width x of the protrusion of the top end $e_p$ of the imagewise light exposure width e over the top end $d_p$ of the developing width d be 0.3 to 3 mm, especially 1 to 1.5 mm. If the protrusion width x is below the above-mentioned range, fogging is often caused by the positional deviation of the developing width or the like. If the protrusion width x exceeds the above-mentioned range, the light exposure efficiency is low. It also is preferred that the developing width d be 5 to 15 mm, especially 8 to 12 mm, and the light exposure width e be 2 to 10 mm, especially 4 to 6 mm.

We claim:

1. An image-forming process which comprises arranging two electrode surfaces, at least one having a curvature face and at least the other being transparent, to confront each other, forming a layer of a photosensitive toner on one of the electrode surfaces, applying a bias voltage so that the polarity of the toner layer-supporting electrode surface is the same as the polarity of charges on the toner and the polarity of the confronting electrode surface is reverse to the polarity of charges on the toner, imagewise irradiating the toner layer with light through the transparent electrode surface at a part where both the electrode surfaces are contacted with each other through the photosensitive toner layer, and transferring the unexposed toner toward the confronting electrode surface, thereby forming a positive image with the transferred toner.

2. A process according to claim 1, wherein the toner layer-supporting electrode surface is an electroconductive sleeve.

3. A process according to claim 2, wherein the electroconductive sleeve has a magnet arranged in the interior thereof and the photosensitive toner is supported in the form of a magnetic brush of a mixture of the photosensitive toner and a magnetic carrier on the electroconductive sleeve.

4. An image-forming process which comprises arranging two electrode surfaces, at least one having a curvature face and at least the other being transparent, to confront each other, forming a layer of a photosensitive toner on one of the electrode surfaces, applying a bias voltage so that the polarity of the toner layer-supporting electrode surface is the same as the polarity of charges on the toner and the polarity of the confronting electrode surface is reverse to the polarity of charges on the toner, irradiating the toner layer with light through the transparent electrode surface at a part where both the electrode surfaces are contacted with each other through the photosensitive toner layer, and transferring the unexposed toner toward the confronting electrode surface, wherein irradiation with light is carried out through a slit having a width smaller than the width of the part of the contact with the photosensitive toner layer.

5. A process according to claim 1, wherein the confronting electrode surface is transparent and irradiation with light is effected through the transparent confronting electrode surface.

6. An image-forming process which comprises arranging two electrode surfaces, at least one having a curvature face and at least the other being transparent, to confront each other, forming a layer of a photosensitive toner on one of the electrode surfaces, said photosensitive toner having such particle size characteristics that the median diameter based on the volume is 5 to 10 μm and the standard deviation of the particle size distribution based on the volume is smaller than 3.33 μm, applying a bias voltage so that the polarity of the toner layer-supporting electrode surface is the same as the polarity of charges on the toner and the polarity of the confronting electrode surface is reverse to the polarity of charges on the toner, irradiating the toner layer with light through the transparent electrode surface at a part where both the electrode surfaces are contacted with each other through the photosensitive toner layer, and transferring the unexposed toner toward the confronting electrode surface.

7. An image-forming process which comprises arranging two electrode surfaces, at least one having a curvature face and at least the other being transparent, to confront each other, forming a layer of a photosensitive toner on one of the electrode surfaces by slidingly contacting said one of the electrode surfaces with a magnetic brush of a mixture of the photosensitive toner and a magnetic carrier, wherein the concentration (Ct, %) of the photosensitive toner in the mixture satisfies the requirement represented by the following formula:

$$Ct = k \cdot \frac{Sc}{St + Sc} \times 100 \quad (1)$$

wherein Sc stands for the specific surface area ($cm^2/g$) of the magnetic carrier, St stands for a specific surface area ($cm^2/g$) of the photosensitive toner, and k is a number of from 1.0 to 2.0, applying a bias voltage so that the polarity of the toner layer-supporting electrode surface is the same as the polarity of charges on the toner and the polarity of the confronting electrode surface is reverse to the polarity of charges on the toner, irradiating the toner layer with light through the transparent electrode surface at a part where both the electrode surfaces are contacted with each other through the photosensitive toner layer, and transferring the unexposed toner toward the confronting electrode surface.

8. An image-forming process comprising forming a magnetic brush composed of a mixture of a photosensitive toner and a magnetic carrier on an electroconductive sleeve, bringing the magnetic brush into contact with a transparent electrode surface, applying a bias voltage between the electroconductive sleeve and the transparent electrode surface and subjecting a part of said contact to the imagewise light exposure through the transparent electrode surface to form a photosensitive toner image on the electrode surface, wherein the imagewise light exposure width is smaller than the width of the contact between the magnetic brush and the transparent electrode surface and the light exposure width is set so that the top end of the imagewise light exposure width slightly protrudes over the top end of said contact width in the direction of advance of the transparent electrode surface, and wherein the bias voltage is applied so that the polarity of the electroconductive sleeve is the same as the polarity of charges on the toner and the polarity of the transparent electrode surface is reverse to the polarity of charges on the toner.

9. An image-forming process comprising forming a magnetic brush composed of a mixture of a photosensitive toner and a magnetic carrier on an electroconductive sleeve, bringing the magnetic brush into contact with a transparent electrode surface, applying a bias voltage between the electroconductive sleeve and the transparent electrode surface and subjecting a part of said contact to the imagewise light exposure through the transparent electrode surface to form a photosensitive toner image on the electrode surface, wherein the bias voltage is applied so that the polarity of the electroconductive sleeve is the same as the polarity of charges on the toner and the polarity of the transparent electrode surface is reverse to the polarity of charges on the toner, and the developing conditions are set so that 1 to 2 photosensitive toner layers are formed on the transparent electrode surface in the non-light-exposed state.

10. An image-forming process comprising forming a magnetic brush composed of a mixture of a photosensitive toner and a magnetic carrier on an electroconductive sleeve, bringing the magnetic brush into contact with a transparent electrode surface, applying a bias voltage between the electroconductive sleeve and the transparent electrode surface and subjecting a part of said contact to the imagewise light exposure through the transparent electrode surface to form a photosensitive toner image on the electrode surface, wherein the bias voltage is applied so that the polarity of the electroconductive sleeve is the same as the polarity of charges on the toner and the polarity of the transparent electrode surface is reverse to the polarity of charges on the toner, and the developing conditions are set so that 1 to 2 photosensitive toner layers are formed on the transparent electrode surface in the non-light exposed state, wherein the ratio of the peripheral speed of the electroconductive sleeve to the moving speed of the transparent electrode surface is in the range of from 5 to 13.

11. An image-forming process comprising forming a magnetic brush composed of a mixture of a photosensitive toner and a magnetic carrier on an electroconductive sleeve, bringing the magnetic brush into contact with a transparent electrode surface, applying a bias voltage between the electroconductive sleeve and the transparent electrode surface and subjecting a part of said contact to the imagewise light exposure through the transparent electrode surface to form a photosensitive toner image on the electrode surface, wherein a photosensitive toner having such particle size characteristics that the median diameter based on the volume is 5 to 10 μm and the standard deviation of the particle size distribution based on the volume is smaller than 3.33 μm is used as the photosensitive toner, the concentration (Ct. %) of the photosensitive toner in the mixture satisfies the requirement represented by the following formula:

$$Ct = k \cdot \frac{Sc}{St + Sc} \times 100 \quad (1)$$

wherein Sc stands for the specific surface area ($cm^2/g$) of the magnetic carrier, St stands for a specific surface area ($cm^2/g$) of the photosensitive toner, and k is a number of from 1.0 to 2.0, the bias voltage is applied so that the polarity of the electroconductive sleeve is the same as the polarity of charges on the toner and the polarity of the transparent electrode surface is reverse to the polarity of charges on the toner, and the developing conditions are set so that 1 to 2 photosensitive toner layers are formed on the transparent electrode surface in the non-light-exposed state, and wherein the imagewise light exposure width is smaller than the width of the contact between the magnetic brush and the transparent electrode surface and the light exposure width is set so that the top end of the imagewise light exposure width slightly protrude over the top end of said contact width in the direction of advance of the transparent electrode surface.

12. A process according to claim 6 wherein the median diameter based on the volume is from 6 to 8 μm.

13. A process according to claim 1 wherein a negative charge is imparted to the photosensitive toner.

14. A process according to claim 5 wherein the toner layer-supporting electrode surface is an electroconductive sleeve having a radius of curvature of 20 to 50 millimeters and the transparent confronting electrode is flat.

15. A process according to claim 5 wherein the toner layer-supporting electrode surface is an electroconductive sleeve having a radius of curvature of 20 to 50 millimeters and the transparent confronting electrode is curved.

16. A process according to claim 10 wherein the ratio of the peripheral speed of the electroconductive sleeve to the moving speed of the transparent electrode surface is in the range of from 6 to 12.

17. A process according to claim 10 wherein the ratio of the peripheral speed of the electroconductive sleeve to the moving speed of the transparent electrode surface is in the range of from 7 to 8.

18. A process according to claim 12 wherein the standard deviation of the particle size distribution based on the volume is smaller than 2.24 μm.

19. A process according to claim 11 wherein k is a number of from 1.2 to 1.8.

20. A process according to claim 7 wherein k is a number of from 1.2 to 1.8.

21. The process of claim 11 wherein the width (d) of the contact between the magnetic brush and the transparent electrode surface is from 5 to 15 mm and the light exposure width (e) is from 2 to 10 mm and the ratio (e/d) is from 0.2 to 0.8, and wherein the width (x) of the protrusion of the imagewise light exposure over the top end of the developing width is from 0.3 to 3 mm.

22. The process of claim 11 wherein the width (d) of the contact between the magnetic brush and the transparent electrode surface is from 8 to 12 mm and the light exposure width (e) is from 4 to 6 mm and the ratio (e/d) is from 0.4 to 0.6, and wherein the width (x) of the protrusion of the imagewise light exposure over the top end of the developing width is from 1 to 1.5 mm.

* * * * *